US011208865B2

(12) United States Patent
Hazel

(10) Patent No.: US 11,208,865 B2
(45) Date of Patent: Dec. 28, 2021

(54) DOWNHOLE STRADDLE ASSEMBLY

(71) Applicant: Welltec Oilfield Solutions AG, Zug (CH)

(72) Inventor: Paul Hazel, Aberdeen (GB)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 432 days.

(21) Appl. No.: 15/618,366

(22) Filed: Jun. 9, 2017

(65) Prior Publication Data

US 2017/0356267 A1 Dec. 14, 2017

(30) Foreign Application Priority Data

Jun. 10, 2016 (EP) ..... 16173982

(51) Int. Cl.
*E21B 33/126* (2006.01)
*E21B 43/12* (2006.01)
(Continued)

(52) U.S. Cl.
CPC ..... *E21B 33/126* (2013.01); *E21B 23/06* (2013.01); *E21B 33/124* (2013.01);
(Continued)

(58) Field of Classification Search
CPC .. E21B 33/124; E21B 33/126; E21B 33/1285; E21B 33/108
See application file for complete search history.

(56) References Cited

U.S. PATENT DOCUMENTS 2,656,891 A * 10/1953 Toelke ..... E21B 33/1204 166/122
4,069,573 A * 1/1978 Rogers, Jr. ..... B21D 22/105 138/98
(Continued)

FOREIGN PATENT DOCUMENTS

EP 2 206 879 A1 7/2010
EP 2 479 376 7/2012
(Continued)

OTHER PUBLICATIONS

Extended Search Report for EP16173982, dated Dec. 12, 2016, 8 pages.
(Continued)

*Primary Examiner* — Steven A MacDonald
(74) *Attorney, Agent, or Firm* — Nixon & Vanderhye P.C.

(57) ABSTRACT

The present invention relates to a downhole straddle assembly for straddling over a zone downhole in a well, the straddle assembly comprising a plurality of tubular sections mounted end to end in succession to form one tubular pipe having a first end tubular section forming a first open end of the tubular pipe, and a second end tubular section forming a second open end of the tubular pipe, said tubular pipe having an outer diameter, wherein the tubular section mounted to the first end tubular section is a first expandable metal sleeve being more pliant than the first end tubular section, and the tubular section mounted with the second end tubular section is a second expandable metal sleeve being more pliant than the second end tubular section. Furthermore, the present invention relates to a downhole straddle system for straddling over a zone downhole in a well and to a downhole straddle method.

16 Claims, 8 Drawing Sheets

Figure 1:
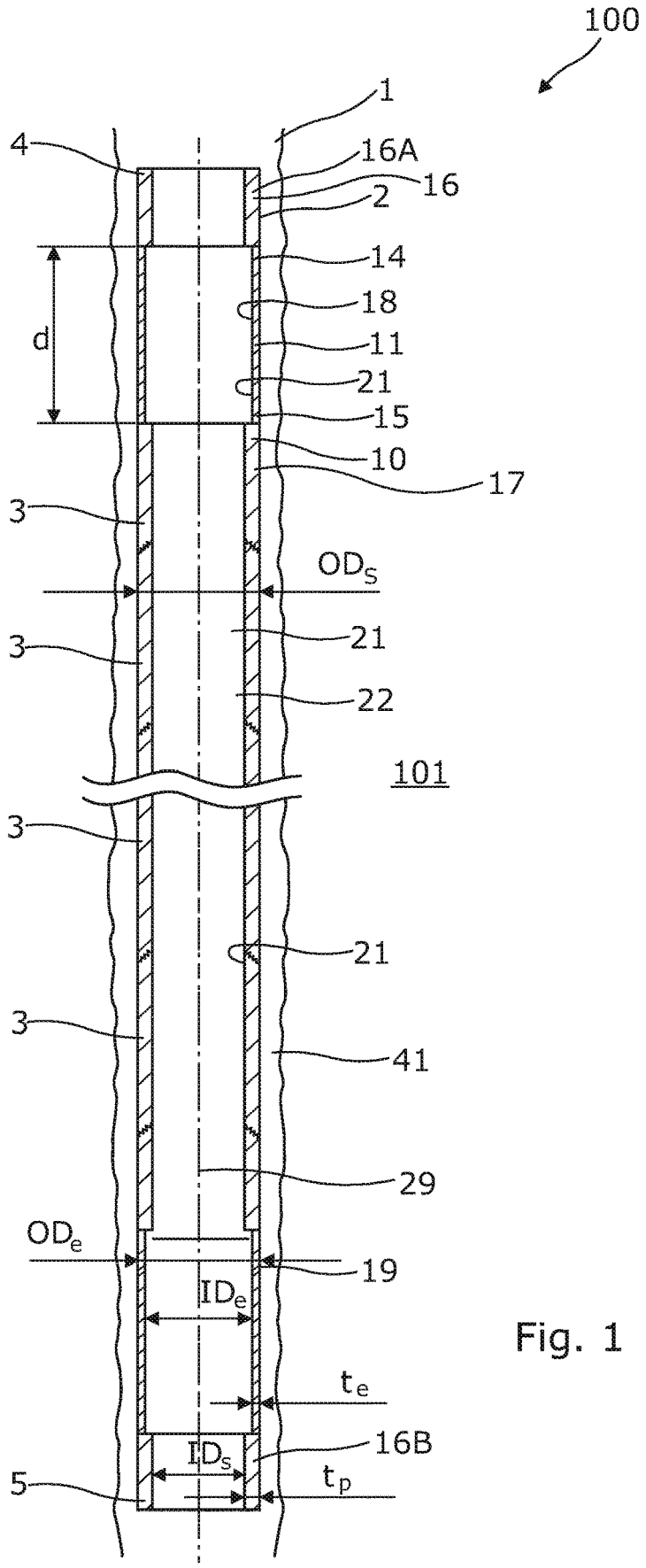

(51) Int. Cl.

| | |
|---|---|
| ***E21B 33/124*** | (2006.01) |
| ***E21B 23/06*** | (2006.01) |
| ***E21B 43/08*** | (2006.01) |
| *E21B 47/07* | (2012.01) |
| *E21B 47/06* | (2012.01) |

(52) U.S. Cl.
CPC ..... *E21B 33/1246* (2013.01); *E21B 43/08* (2013.01); *E21B 43/122* (2013.01); *E21B 43/123* (2013.01); *E21B 47/06* (2013.01); *E21B 47/07* (2020.05)

(56) References Cited

U.S. PATENT DOCUMENTS

| | | | | |
|---|---|---|---|---|
| 5,361,836 | A * | 11/1994 | Sorem | E21B 33/1243 166/187 |
| 6,158,506 | A * | 12/2000 | Carisella | E21B 33/127 166/187 |
| 6,959,759 | B2 * | 11/2005 | Doane | E21B 23/06 166/134 |
| 7,401,647 | B2 | 7/2008 | Ru et al. | |
| 7,661,470 | B2 * | 2/2010 | Doane | E21B 23/06 166/120 |
| 2006/0032628 | A1 * | 2/2006 | McGarian | E21B 29/10 166/191 |
| 2006/0065403 | A1 * | 3/2006 | Watson | E21B 43/103 166/380 |
| 2007/0024053 | A1 * | 2/2007 | Sivley, IV | E21B 43/106 285/333 |
| 2010/0132952 | A1 * | 6/2010 | Nicolas | E21B 43/103 166/369 |
| 2010/0193124 | A1 * | 8/2010 | Nicolas | E21B 29/10 156/294 |
| 2014/0332232 | A1 * | 11/2014 | Butted | E21B 33/1277 166/373 |

FOREIGN PATENT DOCUMENTS

| | | | |
|---|---|---|---|
| EP | 2 586 963 | | 5/2013 |
| EP | 2 599 955 | | 6/2013 |
| EP | 2 607 613 | | 6/2013 |
| EP | 2 942 475 | | 11/2015 |
| RU | 2 374 424 | C1 | 11/2009 |
| RU | 2 379 465 | C1 | 1/2010 |
| SU | 1002514 | A1 | 3/1983 |
| WO | WO 2012/080490 | A1 | 6/2012 |
| WO | WO 2013/126193 | A1 | 8/2013 |
| WO | WO 2015/185683 | A1 | 12/2015 |

OTHER PUBLICATIONS

International Search Report and Written Opinion dated Sep. 15, 2017 in International Application No. PCT/EP2017/064054 (11 pages).

Dreesen, D. S. et al., "Analytical and Experimental Evaluation of Expanded Metal Packers for Well Completion Service," SPE 22858, 66th Annual Technical Conference and Exhibition of the Society of Petroleum Engineers, Dallas, TX, Oct. 6-9, 1991, pp. 413-421.

Office Action of Substantive Examination dated Oct. 14, 2020 in Russian Application No. 2018145641/03(076304), with English translation, 12 pages.

* cited by examiner

DOWNHOLE STRADDLE ASSEMBLY

This application claims priority to EP Patent Application No. 16173982.6 filed 10 Jun. 2016, the entire contents of which is hereby incorporated by reference.

DESCRIPTION

The present invention relates to a downhole straddle assembly for straddling over a zone downhole in a well. Furthermore, the present invention relates to a downhole straddle system and to a downhole straddle method.

When a zone is damaged or producing too much water, the zone needs to be sealed off. However, known solutions are challenged when it comes to isolating zones which are longer than 100 metres, as expansion of a patch assembly mounted from several tubulars in order to be able to cover the entire zone cannot provide proper sealing since the tubulars have shown to separate during such expansion. Another known solution is to insert a new production tubing in the existing production tubing. However, inserting a new production tubing reduces the inner diameter and thus the flow area substantially and hence deteriorates the production. Furthermore, the inner diameter in the small diameter wells may be reduced to an extent where further intervention is no longer possible.

The problem associated with all known solutions is either that the length is insufficient to isolate the entire zone or the inner diameter is reduced too much. There is therefore a need for a solution capable of isolating a zone which is longer than 50 metres and which reduces the inner diameter less than the known solutions while still providing a reliable solution so that the intended zone separation is obtained.

It is an object of the present invention to wholly or partly overcome the above disadvantages and drawbacks of the prior art. More specifically, it is an object to provide an improved downhole solution capable of isolating a zone which is longer than 50 metres and which reduces the inner diameter less than the known solutions while still providing a reliable solution so that the intended zone separation is obtained.

The above objects, together with numerous other objects, advantages and features, which will become evident from the below description, are accomplished by a solution in accordance with the present invention by a downhole straddle system for straddling over a zone downhole in a well, comprising a straddle assembly, the straddle assembly comprising:

a plurality of tubular sections having an outer diameter, and at least two tubular sections being annular barrier sections, each annular barrier section having an expandable metal sleeve having a first end and a second end, wherein each annular barrier section has a first tubular section part and a second tubular section part, and the expandable metal sleeve is arranged between the first tubular section part and the second tubular section part, creating a distance between the first tubular section part and second tubular section part, the first end of the expandable metal sleeve is connected to the first tubular section part, and the second end of the expandable metal sleeve is connected to the second tubular section part.

The present invention also relates to a downhole straddle assembly for straddling over a zone downhole in a well, the straddle assembly comprising:

a plurality of tubular sections mounted end to end in succession to form one tubular pipe having a first end tubular section forming a first open end of the tubular pipe, and a second end tubular section forming a second open end of the tubular pipe, said tubular pipe having an outer diameter, wherein the tubular section mounted to the first end tubular section is a first expandable metal sleeve being more pliant than the first end tubular section, and the tubular section mounted with the second end tubular section is a second expandable metal sleeve being more pliant than the second end tubular section.

The tubular sections may be threadingly connected.

Also, the tubular sections may be mounted end to end in a substantially non-overlapping manner.

Furthermore, the tubular sections may be mounted end to end in a substantially non-overlapping manner except from in the connection between the ends of the tubular sections.

The expandable metal sleeve may be more pliant than the other tubular sections.

Moreover, the expandable metal sleeve may have an outer sleeve diameter in an unexpanded state, the outer sleeve diameter being equal to or smaller than the outer diameter of the other tubular sections forming the tubular pipe.

Also, the expandable metal sleeve may have an inner sleeve diameter being equal to or larger than an inner diameter of the other tubular sections forming the tubular pipe.

Furthermore, the expandable metal sleeves may be expanded by an internal fluid pressure in the tubular pipe.

In addition, the straddle assembly may be made predominantly of metal.

Further, the tubular sections parts may be made of metal.

The expandable metal sleeve may be made of a metal material having a lower yield strength than the tubular sections.

Moreover, the ends of the expandable metal sleeve may be welded to other tubular sections forming the tubular pipe.

Also, the expandable metal sleeve may have a thickness which is less than a part thickness of the other tubular sections forming the tubular pipe.

Furthermore, the expandable metal sleeve may have a first end and a second end at least partly overlapping the ends of the adjacent tubular sections forming the tubular pipe.

Additionally, a plurality of tubular sections may be arranged between the expandable metal sleeves.

Further, at least one of the tubular sections between the expandable metal sleeves may comprise an inflow section, a sensor section or a gas lift valve.

The inflow section may comprise a screen.

Moreover, the straddle assembly may have an inner straddle face forming a flow path in the straddle assembly.

Also, the expandable metal sleeve may have an inner sleeve face forming part of the inner straddle face.

Furthermore, the downhole straddle system as described above may further comprise a downhole tool configured to close the ends of the straddle assembly.

The present invention also relates to a downhole straddle system for straddling over a zone downhole in a well, comprising:

the zone, a borehole and/or a well tubular metal structure, and a downhole straddle assembly according to any of the preceding claims.

The zone may be a collapsed part of the borehole, a production zone, a water producing zone, a valve(s) or opening(s) in the well tubular metal structure.

In addition, the tool may be configured to expand the expandable metal sleeve of the annular barrier section.

Further, the tool may be configured to pressurise a part of the straddle assembly.

The well may comprise a borehole having a wall.

Moreover, the well may comprise a well tubular metal structure having a wall having an inner face, the well tubular metal structure being arranged in the borehole.

Also, an outer face of the expandable metal sleeve may face the wall of the borehole and may be configured to abut the wall of the borehole or the well tubular metal structure after expansion.

The present invention also relates to a downhole straddle method for straddling over a zone which is at least 50 metres long, comprising:

connecting a straddle assembly of a downhole straddle system as described above to a downhole tool closing at least part of the straddle assembly from within opposite the expandable metal sleeves, inserting the straddle assembly into a borehole or a well tubular metal structure, providing the straddle assembly opposite the zone, pressurising the inside of the straddle assembly, and expanding the expandable metal sleeves on either sides of the zone.

Figure 2:
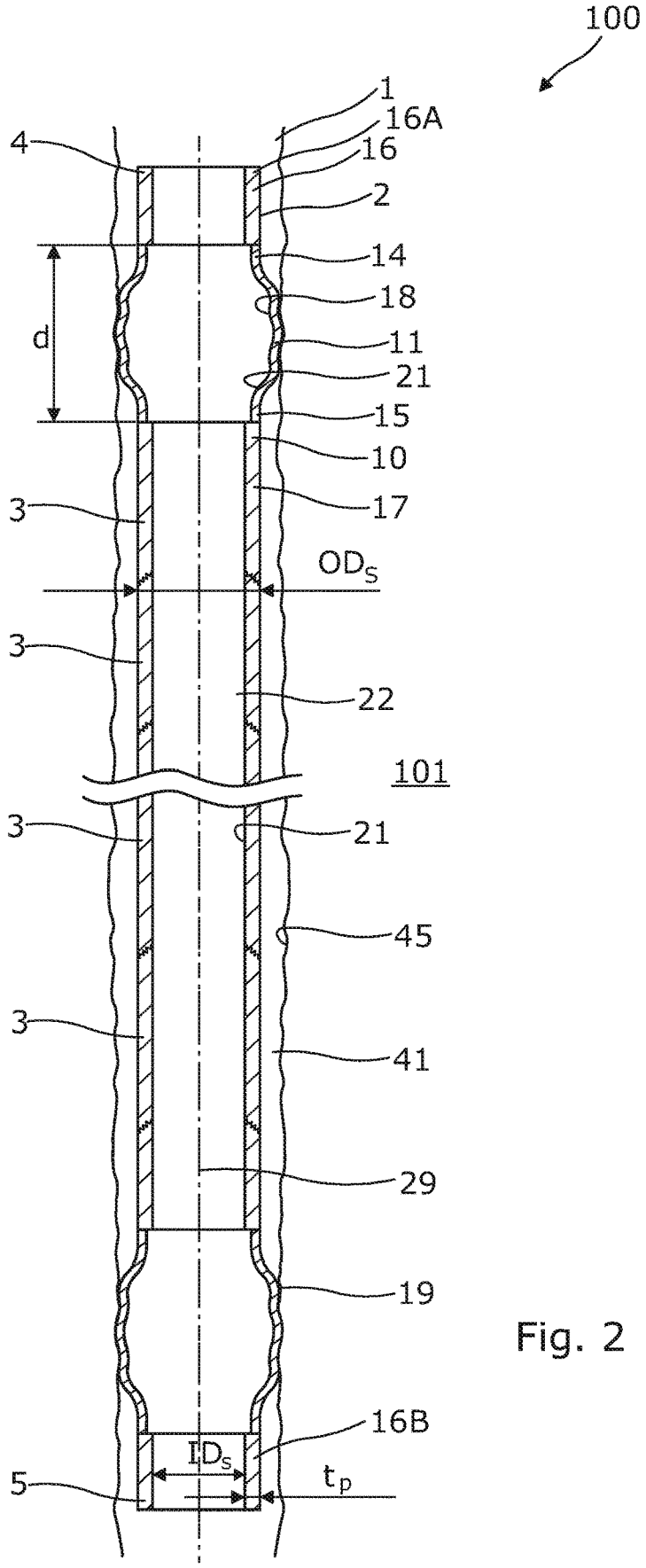
Figure 3:
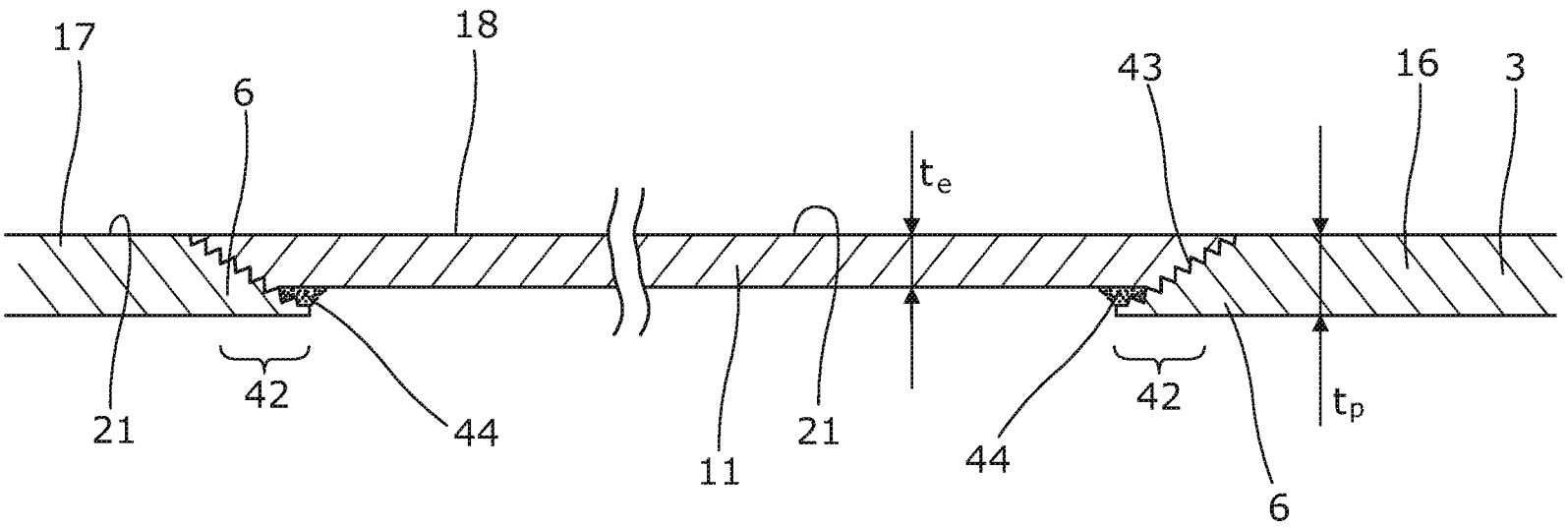
Figure 4:
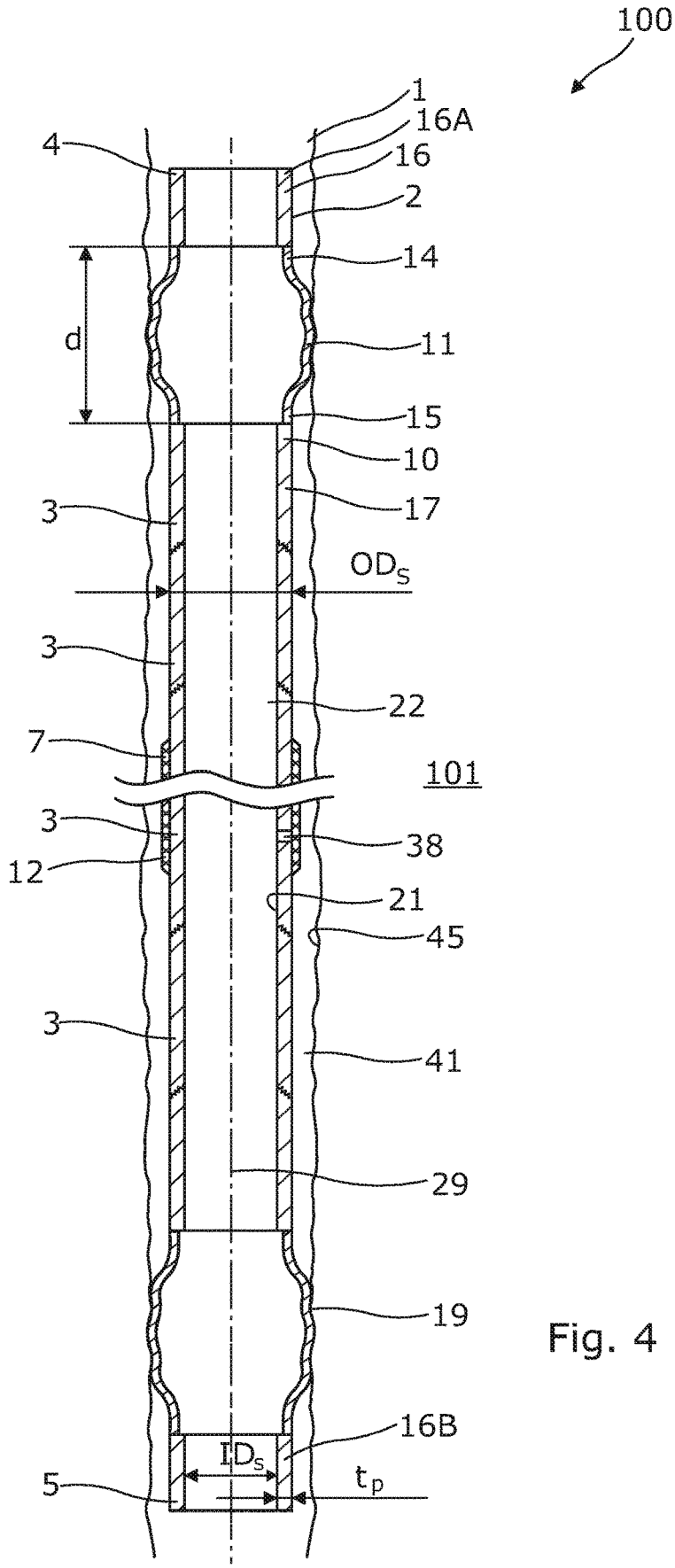
Figure 5:
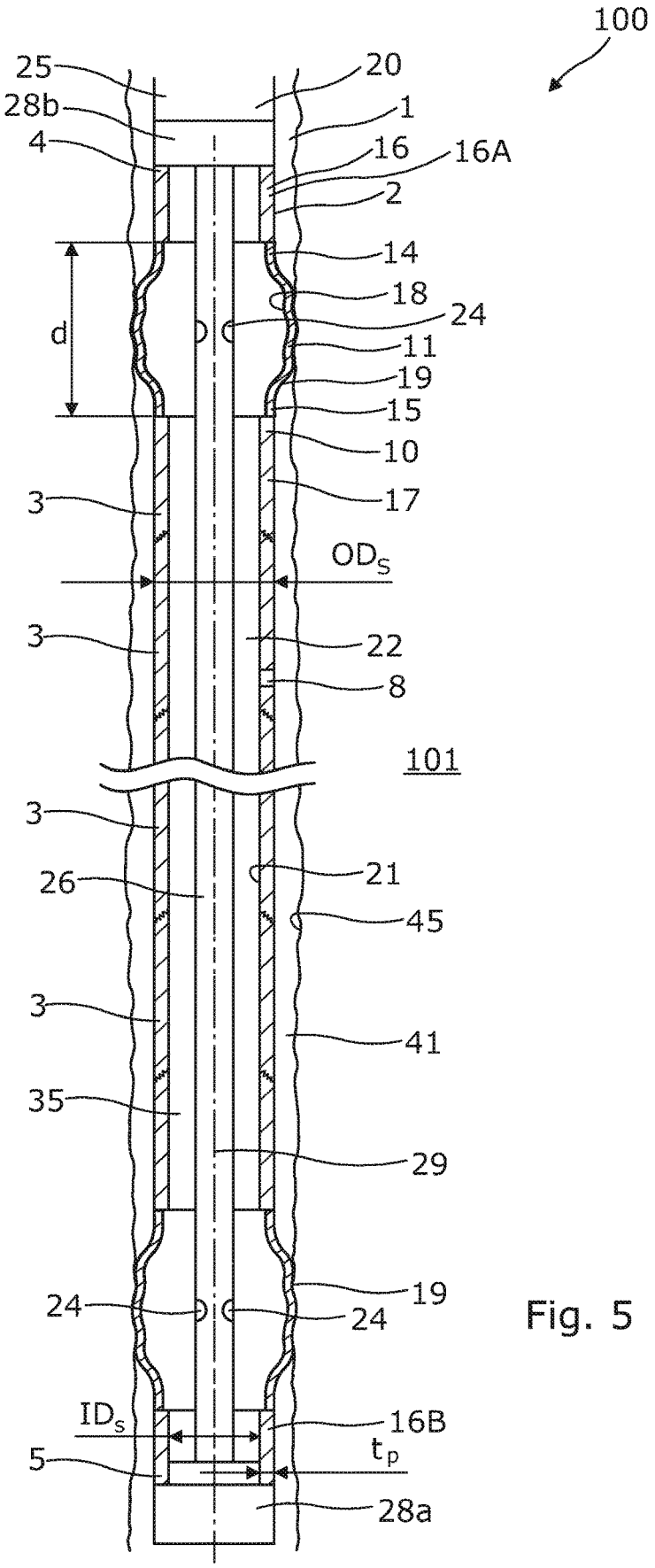
Figure 6:
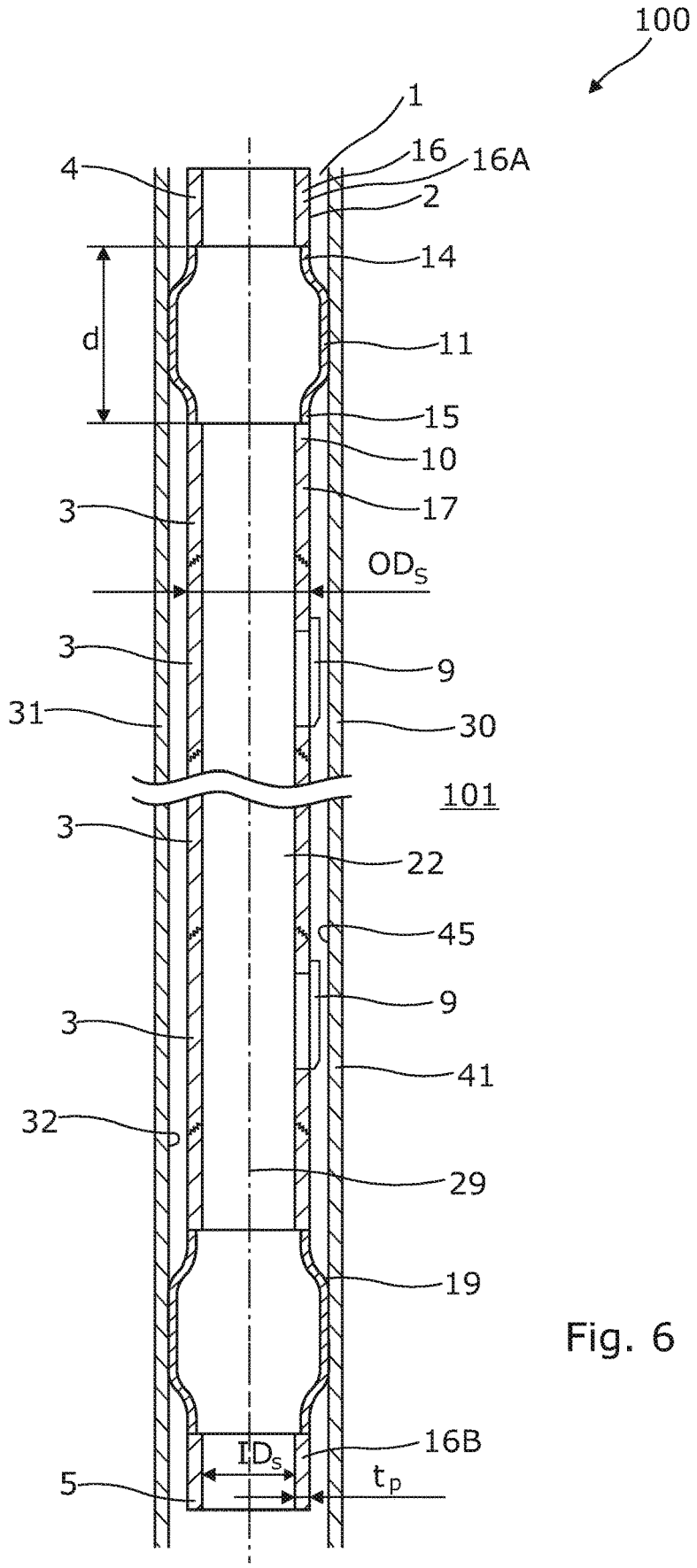
Figure 7:
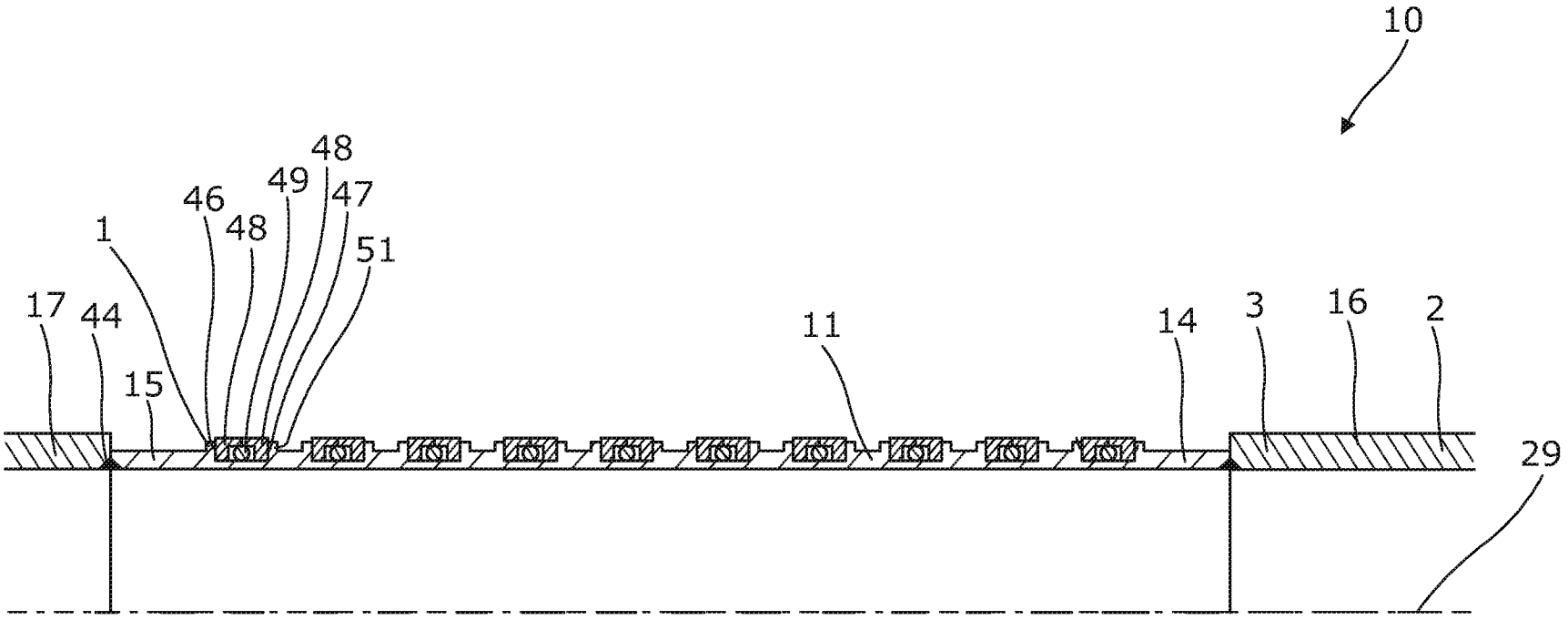
Figure 8:
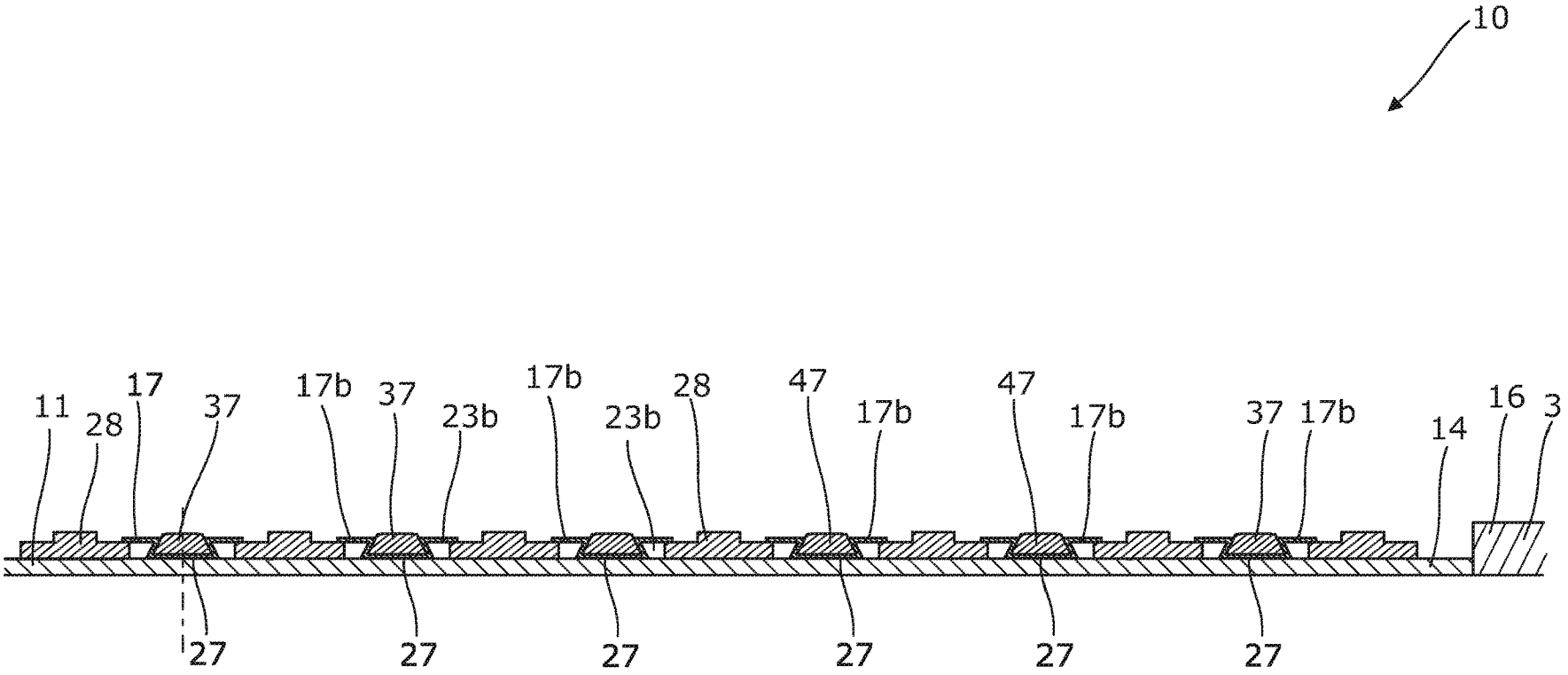

The invention and its many advantages will be described in more detail below with reference to the accompanying schematic drawings, which for the purpose of illustration show some non-limiting embodiments and in which FIG. 1 shows a cross-sectional view of a downhole straddle assembly, in an un-set condition, for straddling over a zone downhole, FIG. 2 shows a cross-sectional view of the downhole straddle assembly of FIG. 1 in an expanded and set condition, FIG. 3 shows a cross-sectional view of part of another downhole straddle assembly, FIG. 4 shows a cross-sectional view of another downhole straddle assembly having a screen, FIG. 5 shows a cross-sectional view of another downhole straddle assembly having a downhole tool, FIG. 6 shows a cross-sectional view of another downhole straddle assembly having gas lift valves, FIG. 7 shows a cross-sectional view of an expandable metal sleeve of the annular barrier sections comprising a sealing arrangement, and FIG. 8 shows a cross-sectional view of another expandable metal sleeve of the annular barrier sections comprising another sealing arrangement.

All the figures are highly schematic and not necessarily to scale, and they show only those parts which are necessary in order to elucidate the invention, other parts being omitted or merely suggested.

FIG. 1 shows a downhole straddle system 100 for straddling over a zone 101 downhole in a well 1. The zone may be a production zone which produces too much water, too much sand or other undesired formation fluid, and which therefore needs to be shut off. The production zone is often at least 50-300 metres long, and normal expandable patches cannot be expanded and used as one patch to cover a zone which is 50-300 metres long. In order to seal off such long zones, several tubular sections 3 are assembled into a straddle assembly 2, and thus the tubular sections 3 are mounted end to end in succession to form one tubular pipe 10. The at least two tubular sections 3 of the tubular sections are an expandable metal sleeve 11 having a first end 14 and a second end 15. The tubular pipe 10 of the straddle assembly 100 has a first open end 4 and a second open end 5. The tubular pipe has a first end tubular section 16A forming the first open end 4 of the tubular pipe, and a second end tubular section 16B forming the second open end 5 of the tubular pipe. The tubular section mounted to the first end tubular section 16A is a first expandable metal sleeve 11 being more pliant than the first end tubular section 16A, and the tubular section mounted with the second end tubular section 16B is a second expandable metal sleeve 11 being more pliant than the second end tubular section 16B.

Each expandable metal sleeve 11, 3 is arranged between the first tubular section 3, 16 and the second tubular section 3, 17, creating a distance d between the first tubular section and the second tubular section. The distance is equal to the length of the expandable metal sleeve along a longitudinal axis 29 of the straddle assembly 2. The first end 14 of the expandable metal sleeve 11 is connected to the adjacent tubular sections 3 of the tubular sections 3 forming the tubular pipe 10 which in FIG. 1 is the first tubular section 16, and the second end 15 of the expandable metal sleeve 11 is connected to the adjacent tubular sections 3 of the tubular sections 3 forming the tubular pipe 10 which in FIG. 1 is the second tubular section 3, 17.

By connecting the tubular sections, in which the expandable metal sleeve is connected end-to-end with the adjacent tubular sections forming the straddle string and not connecting the expandable metal sleeve on the outer face of the tubular pipe, the inner diameter of the straddle assembly can be made bigger, and thus the inner diameter is not reduced as much as in the known solutions. When straddling over a zone in a production well 1, the overall inner diameter of the well is very important as it defines how productive the well can be after the zone has been isolated. The smaller the inner diameter of the straddle assembly, the smaller the resulting flow area of the well 1. Thus, the expandable metal sleeve has an inner sleeve face 18 forming part of an inner straddle face 21 of the straddle assembly 2, and the expandable metal sleeve has an inner sleeve diameter $ID_e$ which is equal to or larger than an inner diameter $ID_s$ of the tubular sections. Hereby, the inner straddle diameter is increased in relation to prior art straddle assemblies.

Since it is only the expandable metal sleeves of the tubular sections which are expanded, the downhole straddle assembly is therefore capable of isolating a very long zone, i.e. a zone which is much longer than 50 metres. Furthermore, by expanding only the expandable metal sleeves of the tubular sections 3, the connections between all the other tubular sections are maintained in an unexpanded sealing condition, providing a reliable solution so that the intended zone separation is obtained.

The tubular sections 3 have an outer diameter $OD_s$, and the expandable metal sleeve has an outer sleeve diameter $OD_e$ in an unexpanded state which is substantially equal to the outer diameter $OD_s$ of the other tubular sections even though the expandable metal sleeve is more pliant, as shown in FIG. 1. Thus the outer sleeve diameter is equal to or smaller than the outer diameter of the tubular sections, so that the expandable metal sleeve is not damaged while the straddle assembly 2 is run into the borehole 41.

In FIG. 2, the straddle assembly 2 is shown in an expanded state in which the expandable metal sleeve of the tubular pipe 10 is expanded, and the straddle assembly is thus set straddling over the zone 101 and the straddle assembly 2 thus seals off the zone 101 so that fluid from the zone is no longer produced in the well 1. The straddle assembly has the inner straddle face 21 forming a flow path 22 in the straddle assembly and a first open end 4 and a second open end 5 so that fluid from other zones are still flowing through the straddle assembly and further up to the top of the well. The expandable metal sleeve is more pliant and more easily expandable than the other tubular sections, so that the expandable metal sleeve is expanded without expanding the first tubular section 16 and the second tubular section 17 of the tubular pipe 10. The expandable metal sleeve 11 is thus made of a metal material having a lower yield strength than the adjacent tubular sections 16, 17. The adjacent tubular sections 16, 17 are also made of metal and the straddle assembly is made predominantly of metal.

In FIGS. 1 and 2, the ends 4, 5 of the expandable metal sleeve are welded to the first tubular section and the second tubular section. In FIG. 3, the ends of the expandable metal sleeve are mainly threadingly connected to the first tubular section 16 by thread 43 and further connected by a weld connection 44. The tubular sections 16, 17 have end parts 6 having a decreased thickness and the end parts at least partly overlap the ends of the expandable metal sleeve. A portion 42 of the end parts 6 of the first tubular section 3, 16 overlaps the expandable metal sleeve 3, 11 functioning as a restriction to prevent free expansion of the expandable metal sleeve and thus to prevent that the expandable metal sleeve is thinning to such an extent during the expansion process that the expandable metal sleeve loses its sealing properties when sealing against the inner wall 45 of the borehole 41 (shown in FIG. 2). Thus, the tubular sections 16, 17 have a part thickness $t_p$ which is larger than a thickness $t_e$ of the expandable metal sleeve.

In FIG. 1, a plurality of tubular sections 3 is arranged end to end in succession of each other to form a tubular pipe 10. In FIGS. 4-6, some of these tubular sections 3 comprise other completion components. In FIG. 4, one tubular section comprises an inflow section 7 having a screen 12 opposite an opening 38. The straddle assembly 2 in FIG. 4 is thus used to insert a screen 12 opposite a zone 101 which e.g. produces too much sand. In FIG. 5, one tubular section comprises a sensor section 8 for measuring a property of the formation fluid, e.g. pressure or temperature. When operating in open-hole parts of the well, inserting a sensor section into the wall of the borehole may be very difficult, and therefore a straddle assembly can be used for such purpose. In FIG. 6, several of the tubular sections comprise a gas lift valve 9 for providing gas lift into part of the well in order for the well to be self-producing again.

The downhole straddle system 100 of FIG. 6 further comprises a well tubular metal structure 30 in which the straddle assembly 2 is inserted. The straddle assembly 2 may then be used to seal off a damaged zone in the well tubular metal structure and thus strengthen that part of the well tubular metal structure if it is about to collapse, or re-establish the production zone by inserting a new inflow section or gas lift valves as shown. The expandable metal sleeves are expanded to seal against the wall 31 of the well tubular metal structure, so that an outer face 19 of the expandable metal sleeve faces abuts the inner face 32 of the wall 31 of the well tubular metal structure after expansion. Thus, the straddle assembly 2 may be arranged opposite a zone 101 having a damaged valve which can no longer close or opposite the openings or perforations in the well tubular metal structure, and the expandable metal sleeve of the straddle assembly is expanded on either side of the valve or openings/perforations.

The expandable metal sleeve 11 of the tubular pipe 10 is expanded by pressurising the flow path 22 of the straddle assembly and temporarily closing the ends 4, 5 of the straddle assembly 2. The expansion process may be performed by means of a downhole tool 20, as shown in FIG. 5. The downhole tool 20 is configured to close the ends 4, 5 of the straddle assembly 2 by means of a first tool part 28*a* and a second tool part 28*b*. The first tool part 28*a* and the second tool part 28*b* are connected by a hollow shaft 26 having openings 24 for providing pressurised fluid into the annular space 35 and thus pressurising the straddle assembly from within to expand the pliant expandable metal sleeves radially outwards in relation to the longitudinal axis 29. The downhole tool 20 may comprise a pump 25 for generating the pressurised fluid, as shown in FIG. 5, or by connecting the tool via pipes or hydraulic lines to surface and having a pump at surface. Thus the tool is configured to expand the expandable metal sleeve of the tubular pipe 10 in one step as the expandable metal sleeves are expanded simultaneously. The first tool part 28*a* and the second tool part 28*b* may be arranged inside the straddle assembly so that the tool pressurises only part of the straddle assembly.

In FIG. 7, the expandable metal sleeve 11 of the tubular pipe 10 comprises a sealing arrangement 47 provided in a groove 46 formed by projections 51 in order to provide a very reliable seal against the inner face of the well tubular metal structure or the borehole. The sealing arrangement 47 comprises a circumferential sealing element 48 and a circumferential resilient element 49. The circumferential sealing element 48 encloses with the groove a space in which the circumferential resilient element 49 is arranged. During expansion of the expandable metal sleeve 11, a portion of the circumferential sealing element 48 is pressed radially inwards when abutting the inner face of the borehole or the well tubular metal structure, so that the circumferential resilient element 49 is squeezed between the portion and the groove, thereby increasing the longitudinal extension of the circumferential resilient element 49. After the expansion of the expandable metal sleeve 11, the residual stresses cause the expandable metal sleeve 11 to spring back towards its original position and thus to a somewhat smaller outer diameter. When this happens, the circumferential resilient element 49 will also partly, if not entirely, return to its original position, and thus press the portion of the circumferential sealing element 48 towards the inner face of the borehole or well tubular metal structure, maintaining the sealing effect of the circumferential sealing element 48.

In FIG. 8, the expandable metal sleeve 11 of the tubular pipe 10 comprises another sealing arrangement 47 and circumferential rings 28 arranged circumferenting the expandable metal sleeve 11, so that when expanded the expandable metal sleeve becomes corrugated thus strenghtening the collapse rating of the expandable metal sleeve. The sealing arrangement comprises a sealing sleeve 27 arranged between two circumferential rings 28. The sealing sleeve 27 has a corrugated shape forming a groove in which a sealing element 37 of e.g. elastomer or rubber is arranged. The sealing sleeve 16 has an opening 17*b* providing fluid communication between the annular space surrounding the expandable metal sleeve and a space 23*b* under the sealing sleeve 27. Thus when the pressure increases in the annular space, the space 23*b* is exposed to the same pressure, and thus the pressure across the sealing element is equalised.

A downhole tool may comprise a stroking tool being a tool providing an axial force for presurising the straddle assembly. The stroking tool may comprise an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid, reservoir fluid, formation fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole straddle assembly for straddling over a zone, which is 50-300 metres long, downhole in a well, the straddle assembly comprising:

a plurality of tubular sections mounted end to end in succession to form one tubular pipe having a first end tubular section forming a first open end of the tubular pipe, and a second end tubular section forming a second open end of the tubular pipe, said tubular pipe having an outer diameter, wherein the tubular section mounted to the first end tubular section is a first expandable metal sleeve being more pliant than the first end tubular section, and the tubular section mounted with the second end tubular section is a second expandable metal sleeve being more pliant than the second end tubular section, wherein a plurality of tubular sections is arranged between consecutive ones of the expandable metal sleeves so that the assembly is between 50-300 metres long, and wherein the expandable metal sleeve has a thickness which is less than a thickness of another part of the other tubular sections forming the tubular pipe; and wherein the first and second expandable metal sleeves are the only expandable metal sleeves with no further expandable metal sleeves between the first and second expandable metal sleeves.

2. A downhole straddle assembly according to claim 1, wherein the expandable metal sleeves are more pliant than the other tubular sections.

3. A downhole straddle assembly according to claim 1, wherein the expandable metal sleeve has an outer sleeve diameter in an unexpanded state, the outer sleeve diameter being equal to or smaller than the outer diameter of the other tubular sections forming the tubular pipe.

4. A downhole straddle assembly according to claim 1, wherein the expandable metal sleeve has an inner sleeve diameter being equal to or larger than an inner diameter of the other tubular sections forming the tubular pipe.

5. A downhole straddle assembly according to claim 1, wherein the expandable metal sleeves are expanded by an internal fluid pressure in the tubular pipe.

6. A downhole straddle assembly according to claim 1, wherein the ends of the expandable metal sleeve are welded to other tubular sections forming the tubular pipe.

7. A downhole straddle assembly according to claim 1, wherein the expandable metal sleeve has a first end and a second end at least partly overlapping the ends of the adjacent tubular sections forming the tubular pipe.

8. A downhole straddle assembly according to claim 1, wherein at least one of the tubular sections between the expandable metal sleeves comprises an inflow section, a sensor section or a gas lift valve.

9. A downhole straddle assembly according to claim 8, wherein the inflow section comprises a screen.

10. A downhole straddle assembly according to claim 1, wherein the straddle assembly has an inner straddle face forming a flow path in the straddle assembly.

11. A downhole straddle assembly according to claim 10, wherein the expandable metal sleeve has an inner sleeve face forming part of the inner straddle face.

12. A downhole straddle assembly according to claim 1, further comprising a downhole tool configured to close the ends of the straddle assembly.

13. A downhole straddle system for straddling over a zone downhole in a well, comprising:

the zone, a borehole and/or a well tubular metal structure, and a downhole straddle assembly according to claim 1.

14. A downhole straddle system according to claim 13, wherein the zone is a collapsed part of the borehole, a production zone, a water producing zone, a valve(s) or opening(s) in the well tubular metal structure.

15. A downhole straddle assembly according to claim 1, wherein at least a selected one of the plurality of tubular sections that are between the consecutive expandable sleeves has a different functionality compared to the remaining ones of the tubular sections that are between the consecutive expandable sleeves.

16. A downhole straddle method for straddling over a zone which is at least 50 metres long, comprising:

connecting a straddle assembly of a downhole straddle system according to claim 1 to a downhole tool closing at least part of the straddle assembly from within opposite the expandable metal sleeves, inserting the straddle assembly into a borehole or a well tubular metal structure, providing the straddle assembly opposite the zone, pressurising the inside of the straddle assembly, and expanding the expandable metal sleeves on either sides of the zone.

* * * * *